US007341531B2

(12) United States Patent
Caruso

(10) Patent No.: US 7,341,531 B2
(45) Date of Patent: Mar. 11, 2008

(54) PORTABLE ANCHORING DEVICE FOR A SPORTS GOAL

(75) Inventor: Anthony Caruso, Center Valley, PA (US)

(73) Assignee: Kwik Goal Ltd, Quakertown, PA (US)

( * ) Notice: Subject to any disclaimer, the term of this patent is extended or adjusted under 35 U.S.C. 154(b) by 94 days.

(21) Appl. No.: 11/356,603

(22) Filed: Feb. 17, 2006

(65) Prior Publication Data

US 2007/0194534 A1 Aug. 23, 2007

(51) Int. Cl.
*A63B 63/00* (2006.01)

(52) U.S. Cl. ..... 473/478; 273/400

(58) Field of Classification Search ..... 273/398–402; 473/476–478, 481–488; 405/172
See application file for complete search history.

(56) References Cited

U.S. PATENT DOCUMENTS

| | | | | |
|---|---|---|---|---|
| 2,020,158 | A | 11/1935 | Oakes | |
| 3,399,889 | A * | 9/1968 | Harry | 473/481 |
| 3,743,286 | A * | 7/1973 | Weinhagen et al. | 473/481 |
| 4,913,428 | A | 4/1990 | Nauman | |
| 5,294,129 | A * | 3/1994 | Brown | 473/514 |
| 5,367,503 | A | 11/1994 | Lowrance | |
| 5,452,877 | A | 9/1995 | Riffle | |
| 5,651,551 | A | 7/1997 | Ferrara | |
| 5,661,933 | A | 9/1997 | DeJonghe | |
| 5,820,497 | A | 10/1998 | Pena | |
| 6,082,697 | A | 7/2000 | Grunfeld | |
| 6,220,788 | B1 * | 4/2001 | Jewell | 405/172 |
| 6,308,468 | B1 | 10/2001 | Caruso | |
| 6,435,512 | B1 * | 8/2002 | Beckwith, Sr. | 273/407 |
| 6,808,463 | B1 | 10/2004 | Stockwell, III | |
| 2005/0082761 | A1 * | 4/2005 | Lynch | 273/343 |
| 2006/0033282 | A1 * | 2/2006 | Fenwick | 273/398 |
| 2007/0078022 | A1 * | 4/2007 | Justice | 473/185 |

OTHER PUBLICATIONS

Kwikgoal, "Assembly Instructions for 2B3306 Evolution Goal", 13 page assembly instructions for soccer goal, Jan. 17, 2005.

* cited by examiner

*Primary Examiner*—Mark S Graham
(74) *Attorney, Agent, or Firm*—Howson & Howson LLP

(57) ABSTRACT

An anchoring device for a sports goal, such as a soccer goal, is provided as a portable bag having a pair of laterally spaced-apart weight-carrying compartments interconnected by at least one central strip of material. The central strip defines at least one opening extending between the weight-carrying compartments, and the portable bag is of a size capable of straddling a base rail of a sports goal frame such that the weight-carrying compartments are located on opposite sides of the base rail while the strip extends over the base rail. When the portable bag straddles the base rail, the opening permits a goal net to be fastened to the base rail of the goal frame between the weight-carrying compartments.

12 Claims, 3 Drawing Sheets

PORTABLE ANCHORING DEVICE FOR A SPORTS GOAL

BACKGROUND OF THE INVENTION

The present invention relates to anchoring sports goals and the like to underlying indoor or outdoor surfaces, and more particularly, to a portable anchoring device, a sports goal assembly that includes an anchoring device, and a method for anchoring a sports goal.

Various structures, such as sport goal frames, benches, and the like require anchoring to an underlying ground surface for safety and other reasons. For example, the frames of soccer goals require anchoring to an underlying playing surface to prevent accidental tilting over of the goals which may cause injury to players or other persons located nearby. This is true for goals located on outdoor playing surfaces as well as goals located indoors.

Examples of anchoring sport goals are provided by U.S. Pat. No. 6,082,697 issued to Grunfield; U.S. Pat No. 6,808,463 B1 issued to Stockwell, III; U.S. Pat. No. 4,913,428 issued to Nauman; U.S. Pat. No. 5,820,497 issued to Pena; U.S. Pat. No. 5,661,933 issued to DeJonghe; U.S. Pat. No. 2,020,158 issued to Oakes et al.; and U.S. Pat. No. 5,651,551 issued to Ferrara et al. In addition, see U.S. Pat. No. 6,308,468 issued to Caruso and co-pending U.S. patent application No. 11/319,948 filed on Dec. 28, 2005. Also see U.S. Pat. No. 5,432,877 issued to Riffle et al. and U.S. Pat. No. 5,367,503 issued to Lowrance for the use of sand bags as anchoring devices.

Although the above referenced anchor devices, sports goal assemblies, and methods of anchoring sports goals disclosed in the above referenced patents may be satisfactory for their intended purposes, there is a need for a portable anchoring device, goal assembly utilizing the portable anchoring device, and method of anchoring a sports goal that can be used on both indoor and outdoor playing surfaces. The anchoring device should be capable of being readily attached to and removed from various goals supported on various indoor and outdoor playing surfaces in a manner requiring a minimum of time, effort, skill and labor. In addition, the anchoring device should be portable and capable of ready transport and storage.

BRIEF SUMMARY OF THE INVENTION

The present invention is an anchoring device for a sports goal, such as a soccer goal, and is in the form of a portable bag having a pair of laterally spaced-apart weight-carrying compartments that are interconnected by at least one central strip of material extending therebetween. The central strip defines at least one opening extending between the weight-carrying compartments, and the portable bag is of a size capable of straddling a base rail of a sports goal frame such that the weight-carrying compartments are located on opposite sides of the base rail while the strip extends over the base rail. When the portable bag straddles the base rail, the opening permits a goal net to be fastened to the base rail of the goal frame between the weight-carrying compartments.

According to another aspect of the present invention, a sports goal assembly is provided. The assembly includes a rigid goal frame defining an upright goal mouth and having at least one base rail extending behind the goal mouth along and parallel to an underlying playing surface. A perimeter portion of a goal net is secured to the goal frame, and a portable weighted bag is positioned on the base rail for anchoring the goal frame to the underlying playing surface.

The portable bag has a pair of laterally spaced-apart weight-carrying compartments and is capable of straddling the base rail such that the compartments are positioned on the underlying playing surface on opposite sides of the base rail. At least one opening extends through the portable weighted bag between the compartments, and a portion of the goal net extends through the opening and is fastened to the base rail.

According to a further aspect of the present invention, a method of assembling a sports goal is provided. A goal frame is supported on an underlying ground surface. The goal frame defines an upright goal mouth and has at least one base rail. A portable weighted bag is straddled across the base rail of the goal frame. A perimeter portion of a goal net is secured to the base rail through an opening extending through the portable weighted bag.

BRIEF DESCRIPTION OF THE DRAWINGS

The present invention should become apparent from the following description when taken in conjunction with the accompanying drawings, in which.

DETAILED DESCRIPTION OF THE INVENTION

Figure 1:
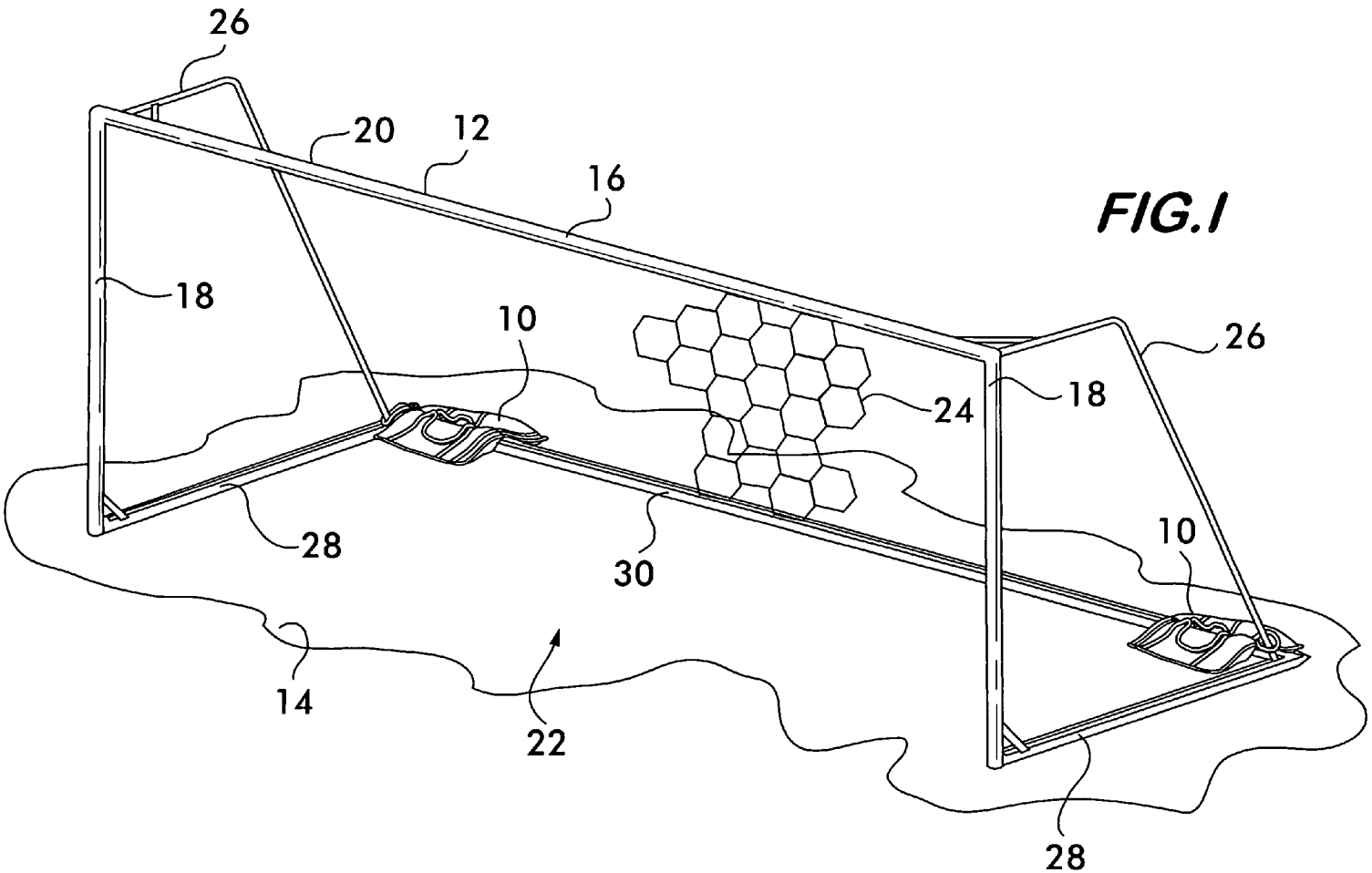
FIG. 1 is perspective view of a sports goal assembly according to the present invention.

The anchoring device of the present invention is useful in securing sport goal frames, park benches, picnic tables, and like structures to underlying ground surfaces. Preferably, the anchoring device is provided in the form of a portable weight bag that can be used on both outdoor and indoor surfaces. For example, as best illustrated in FIG. 1, one or more weight bags 10 according to the present invention can be used with a soccer goal 12 to prevent accidental tipping of the goal. The underlying surface 14 on which goal 12 is supported can be an outdoor natural grass or artificial playing field or any type of indoor playing surface.

A typical soccer goal 12 has a frame 16 including a pair of goal posts 18 and a crossbar 20 that together define a goal mouth 22 extending upright from the playing surface 14. The soccer goal 12 may also include other framing elements needed to support a goal net 24 a spaced distance behind the goal mouth 22. For example, the illustrated frame 16 includes a pair of arm assemblies 26 that extend rearward from the goal posts 18 and that each includes a lower horizontal base rail 28. An additional cross base rail 30 may be used to interconnect the base rails 28.

Each of the base rails, 28 and 30, extends along and substantially parallel to the underlying surface 14 and is freely supported thereon. The perimeter rope, or edge, 32 of the goal net 24 is fastened to the frame 16 so that a soccer ball (not shown) passing through the goal mouth 22 remains captured within the goal 12 and cannot pass beyond the net 24. Typically, the perimeter rope 32 of the net 24 is connected at spaced intervals to the rear sides of the goal posts 18 and crossbar 20 and to the top surfaces of base rails 28 and 30 and is draped over arm assemblies 26. The spaced intervals must be sufficiently small to prevent a ball from passing between the net 24 and the frame 16.

The anchoring device according to the present invention is in the form of a bag 10 having a handle 34 which enables the bag 10 to be carried by hand to a goal and be positioned on a base rail, 28 or 30, thereof. As an example, the bag 10 can be made of canvas or like material and by itself may only weigh about a pound. Preferably, an additional substance 36 is added into, or carried by, the bag 10 to provide the requisite weight. For instance, the substance 36 can be sand, stone, gravel, solid weights in the form of bars, discs, or the like, containers filled with a fluid substance, or any like substance capable of adding weight to the bag 10. In one contemplated embodiment, the bag 10 is designed to support approximately forty pounds of weights, such as forty pounds of sand. Of course, the bag 10 can be designed to carrying more or less weight, as desired.

In the illustrated embodiment, the bag 10 has a spaced-apart pair of weight-carrying compartments 38 and 40 interconnected by a central strip of material 42. As an alternative, each compartment, 38 and 40, could each be comprised of several separate weight-carrying compartments and/or the central strip can be comprised of several separate straps. Preferably, the handle 34 extends above the central strip 42 so that, when the bag is carried, the central strip 42 forms a top wall of the bag 10 with the compartments, 38 and 40, depending from opposite lateral sides thereof. This ensures that the handle 34 extends above the center of gravity of the bag 10 for ease of carrying.

When the bag 10 is positioned on a base rail, 28 or 30, of a goal 12, the bag 10 is positioned such that it straddles the rail, 28 or 30. The weight-carrying compartments 38 and 40 are located on opposite sides of the rail and are supported on the underlying surface 14. The central strip 42 extends across and is supported on the rail, 28 or 30. For an example of the straddled position, see FIG. 4.

When laid flat, the illustrated embodiment of the bag 10 has a relatively rectangular perimeter in plan view. Each of the compartments, 38 and 40, is provided as a relatively elongate pocket that extends substantially parallel to the other pocket. A fastening device 44, such as a zipper, extends transversely across the bag 10 adjacent an end thereof and provides openings 46 through which the substance 36 can be placed or removed from the compartments, 38 and 40. The fastening device 44 also permits the openings 46 of the compartments, 38 and 40, to be sealed closed after the compartments, 38 and 40, are filled. As an alternative to the illustrated embodiment, one or more closure flaps or the like can be used to seal the compartments closed and the fastening device can be a hook and loop fastener, a snap fastener, straps, buckles, buttons, or the like.

The central strip 42 defines at least one opening 48 extending through the bag 10 at a location between the compartments, 38 and 40. In the illustrated embodiment of FIG. 2, the central strip 42 defines a pair of spaced-apart openings 48. The purpose of the openings 48 is to permit the goal net 24 to be fastened to the base rail, 28 or 30, at the location of the bag 10. For example, the perimeter rope 32 of the net 24 can be secured with clips 50 to the base rail, 28 or 30, through each opening 48 thereby ensuring that the interval between such connections is relatively small. Of course, the goal net 24 can also be fastened to the base rail, 28 or 30, adjacent the opposite ends of the bag 10. Thus, the openings 48 ensure that the bag 10 does not interfere with the connection of the net 24 to the base rail, 28 or 30, at required intervals.

Figure 4:
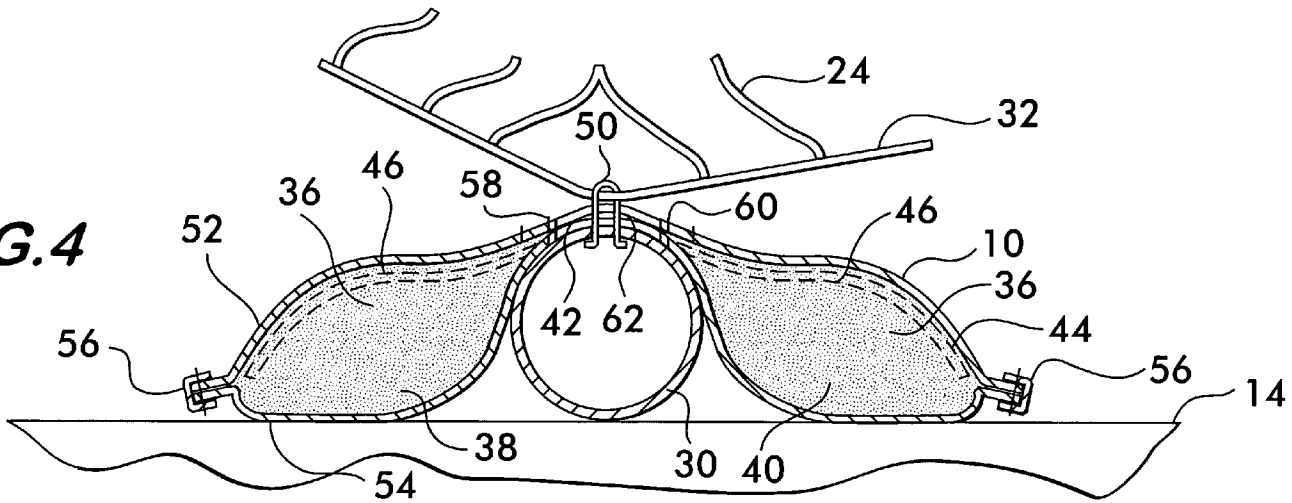
FIG. 4 is a cross-sectional view along line 4-4 of FIG. 3.

According to one contemplated embodiment, the bag 10 is made from two substantially rectangular panels of material, such as canvas. As best illustrated in FIG. 4, an upper wall panel 52 extends continuously across the upper face of the bag 10 and a lower wall panel 54 extends continuously across the lower face of the bag 10. The outer peripheral edges 56 of panels 52 and 54 are stitched together, and the panels 52 and 54 are stitched together at intermediate locations, 58 and 60 to define the inner peripheral edges of the compartments, 38 and 40. The central strip of material 42 extends between stitched intermediate locations 58 and 60. Preferably, a sheet of plastic or like reinforcement material 62 is embedded between panels 52 and 54 in the central strip 42 to reinforce this area of the bag 10. Preferably, the openings 48 in the central strip 42 are defined by aligned apertures extending through the reinforcement sheet 62 and the panels 52 and 54.

Figure 2:
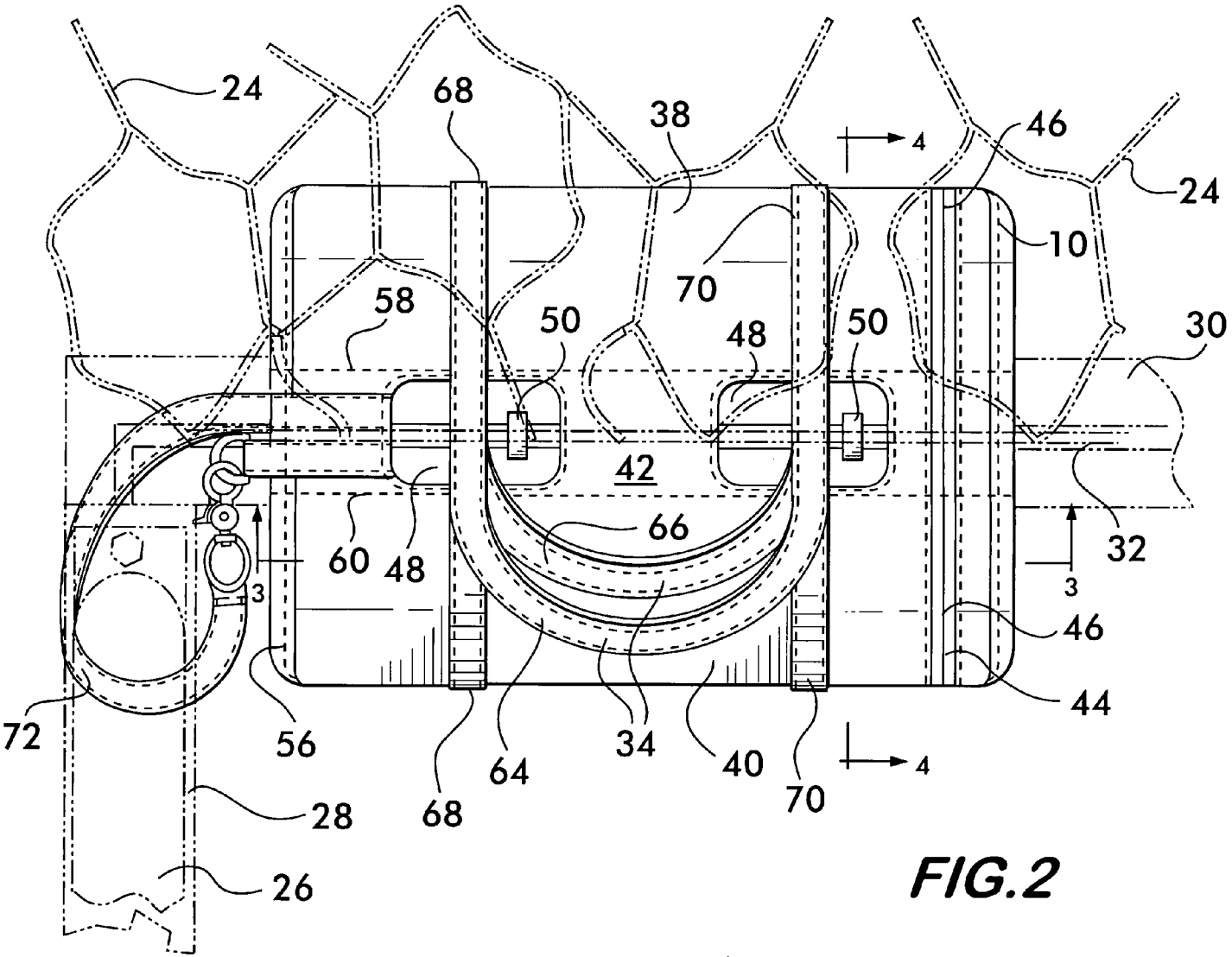
FIG. 2 is a plan view of an anchoring device according to the present invention assembled with a goal frame and net shown in phantom.
Figure 3:
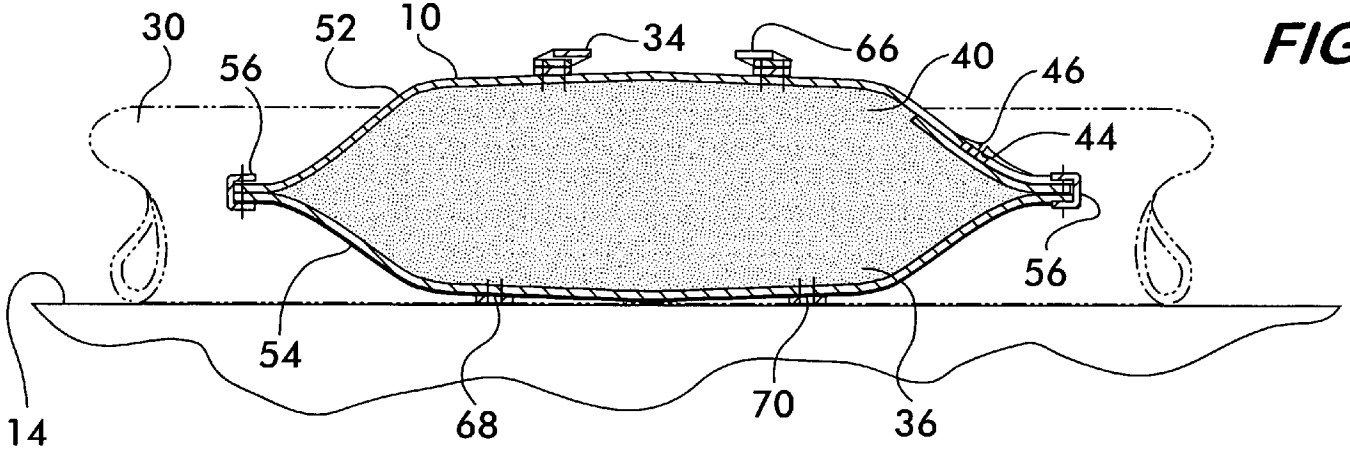
FIG. 3 is a cross-sectional view along line 3-3 of FIG. 2.

Preferably, the handle 34 is provided as two separate strips, 64 and 66, of webbing material, such as strips of nylon. Each strip, 64 and 66, encircles and is stitched to one of the compartments, 38 and 40, at two spaced apart locations, 68 and 70. The portion of the strips, 64 and 66, that bridges from location 68 to location 70 is provided with some slack and provides a handle gripping location. As illustrated in FIG. 2, another strip of webbing 72 extends transversely from one end of the bag 10 and enables the bag 10 to be connected to an adjacent framing element or an adjacent bag 10. This prevents unintended movement of the bag 10 relative to the goal frame 16.

In use, the fastening device 44 of an empty bag 10 is utilized to open the compartments, 38 and 40, and the compartments are filled with sand or like substance 36. The handle 34 is gripped, and the portable bag 10 is carried to a goal location. One or more bags 10 are placed on a base rail, 28 or 30, of a goal frame 16 such that the bags 10 straddle the base rail. The weighted compartments, 38 and 40, are located on opposite sides of the rail and prevent the goal frame 16 from tipping over or from any other unintended movement relative to the underlying playing surface 14.

The goal net 24 is secured to the base rail, 28 or 30, with clips 50 or the like through the openings 48 in the central strip 42 of the bag 10. This enables the attachment points of the net to the frame to be at close intervals thereby preventing a ball from escaping under the net at the location of the bag 10. In the illustrated embodiment, the rail 30 has a channel into which clips 50 are secured. Other means of attaching the net to the frame can also be utilized.

While a preferred anchor, sports goal assembly, and method have been described in detail, various modifications, alterations, and changes may be made without departing from the spirit and scope of the anchor, assembly, and method according to the present invention as defined in the appended claims.

The invention claimed is:

1. A sports goal assembly, comprising:

a rigid goal frame defining an upright goal mouth and having at least one base rail extending behind said goal mouth and along and parallel to an underlying support surface;

a goal net having a perimeter which is secured to said goal frame; and a portable bag positioned on said base rail for anchoring said goal frame to the underlying support surface;

said portable bag having a pair of laterally spaced-apart weight-carrying compartments capable of straddling said base rail such that said compartments are positioned on said underlying support surface on opposite sides of said base rail; and at least one opening extends through said portable bag between said compartments such that said goal net is fastened to said base rail through said opening.

2. A sports goal assembly according to claim 1 wherein said bag has a central strip of material interconnecting said compartments and defining said at least one opening, said central strip of material extending over said base rail between said compartments.

3. A sports goal assembly according to claim 2, wherein said bag has a grippable handle permitting said bag to be readily carried to and from said assembly and readily positioned on said base rail.

4. A sports goal assembly according to claim 3, further comprising a fastener for securing said perimeter of said goal net to said base rail through said opening of said bag.

5. A sports goal assembly according to claim 3, wherein said bag is filled with up to about 40 lbs. of sand or stone and wherein said central strip has a least two-spaced apart openings through which said goal net can be fastened to said base rail.

6. A sports goal assembly according to claim 2, wherein said central strip defines at least a pair of separate, spaced-apart openings through which the goal net is securable to the base rail.

7. A sports goal assembly according to claim 6, wherein said central strip includes a central reinforcing strip of plastic having said openings formed therethrough.

8. A sports goal assembly according to claim 1, wherein said bag has a grippable handle.

9. A sports goal assembly according to claim 1, further comprising a fastener for securing said perimeter of said goal net to said base rail through said opening of said bag.

10. A sports goal assembly according to claim 1, wherein each of said weight-carrying compartments is provided as an elongate pocket into which a substance functioning as a weight is removably receivable.

11. A sports goal assembly according to claim 10, wherein said elongate pockets extend substantially parallel to each other and substantially parallel to said base rail.

12. A sports goal assembly according to claim 11, wherein each of said elongate pockets has an open end through which the substance functioning as the weight is insertable and a fastening means for securing said open end closed to capture the substance functioning as the weight within said pocket.

* * * * *